US006957695B2

(12) United States Patent
Lomax, Jr. et al.

(10) Patent No.: US 6,957,695 B2
(45) Date of Patent: Oct. 25, 2005

(54) HEAT EXCHANGER HOUSING AND SEALS

(75) Inventors: Franklin D. Lomax, Jr., Arlington, VA (US); Kim Hong Lim, Annandale, VA (US); Stephen Waide, Arlington, VA (US)

(73) Assignee: H2Gen Innovations, Inc., Alexandria, VA (US)

( * ) Notice: Subject to any disclaimer, the term of this patent is extended or adjusted under 35 U.S.C. 154(b) by 34 days.

(21) Appl. No.: 10/436,060

(22) Filed: May 13, 2003

(65) Prior Publication Data

US 2004/0226701 A1 Nov. 18, 2004

(51) Int. Cl.[7] ..... F28D 7/16
(52) U.S. Cl. ..... 165/159; 165/82; 165/140
(58) Field of Search ..... 165/82, 140, 145, 165/159

(56) References Cited

U.S. PATENT DOCUMENTS

| | | | | | |
|---|---|---|---|---|---|
| 1,901,370 | A | * | 3/1933 | Kuhner | 165/119 |
| 2,595,822 | A | | 5/1952 | Uggerby | |
| 3,147,084 | A | * | 9/1964 | Franzen et al. | 165/140 |
| 3,842,904 | A | * | 10/1974 | Gardenier | 165/145 |
| 3,861,460 | A | * | 1/1975 | Lenhardt | 165/158 |
| 4,034,717 | A | * | 7/1977 | Clum et al. | 165/145 |
| 4,279,293 | A | * | 7/1981 | Koump | 165/82 |
| 4,522,252 | A | * | 6/1985 | Klaren | 165/159 |
| 4,660,631 | A | * | 4/1987 | Small | 165/159 |
| 4,733,722 | A | | 3/1988 | Forbes et al. | |
| 4,778,005 | A | | 10/1988 | Smith | |
| RE33,444 | E | * | 11/1990 | Lerner | 165/159 |
| 5,048,601 | A | * | 9/1991 | Yamaguchi et al. | 165/140 |
| 5,642,774 | A | * | 7/1997 | Christenson | 165/82 |
| 6,102,995 | A | * | 8/2000 | Hutchings et al. | 106/18.15 |
| 6,106,789 | A | * | 8/2000 | Thompson et al. | 165/145 |
| 6,497,856 | B1 | | 12/2002 | Lomax, Jr. et al. | |
| 6,613,296 | B1 | * | 9/2003 | Myers et al. | 422/179 |

OTHER PUBLICATIONS

U.S. Appl. No. 10/429,689, filed May 6, 2003, Lomax.
U.S. Appl. No. 10/436,060, filed May 13, 2003, Lomax et al.
Written Opinion.

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

A housing for a heat exchange apparatus including a fluid passageway partially defined by a baffle plate having an extended portion. The heat exchange apparatus further includes an array of fluid conduits extending through the fluid passageway. The housing includes a plurality of housing members each having a wall and at least one flange extending from the wall. The flanges of adjacent housing members are joined at a flange joint, and the flange joint is configured to fixedly receive the extended portion of the baffle plate. The apparatus also includes a plate member is provided within the fluid passageway and intumescent material fills a gap between the baffle plate and the plate member. Additionally, a second baffle plate is provided that defines a portion of a second fluid passageway, where a refractory gasket and a layer of intumescent material are provided between the first and second baffle plates.

45 Claims, 5 Drawing Sheets

HEAT EXCHANGER HOUSING AND SEALS

BACKGROUND OF THE INVENTION

1. Field of the Invention

The present invention relates generally to heat exchangers and methods of constructing heat exchangers.

2. Discussion of the Background

Heat exchangers and heat exchange chemical reactors having large arrays of parallel tubes are known in the art. Traditional design practices for such articles are codified in design standards. It is known that flow leakage bypassing the flow passages outside the surfaces of the tubes, commonly referred to as the "shell side" of the "tube and shell" exchanger, limits design thermal performance significantly.

Various techniques are used to advantageously increase heat transfer area per unit volume in heat exchangers, such as the use of tubes with extended heat transfer surfaces and the use of an especially-closely packed array of tubes. Such configurations are of important in the construction of compact, cost-effective heat exchange structures. However, the use of such configurations exacerbates the problem of flow bypassing in tube and shell heat exchangers. Therefore, the heat exchanger industry has attempted to limit the effects of flow bypassing by decreasing pressure drop through the flow passages by spacing the tubes far apart and by providing little or no extended heat transfer surfaces (often referred to as fins), which decrease the compactness and cost-effectiveness of the heat exchanger. Alternatively, the heat exchanger industry has attempted to limit the effects of flow bypassing by providing sealing elements to limit leakage in any given flow passage outside the tubes. However, these methods of limiting flow bypassing have several severe limitations.

The method described in U.S. Pat. No. 2,595,822, to Uggersby (hereinafter "the '822 patent"), provides elastic elements formed from metal that possess a rounded outer shape. Such elements are limited to tubular heat exchange arrays having a rounded plan form, such as those referred to as tube and shell exchangers. Further, these elements are limited in their ability to seal against surfaces of high roughness or local surface imperfection. The '822 patent describes a method that is relatively impractical, since many tube and shell exchangers have a rounded shell manufactured by welding rolled plates, and thus local irregularities can only be removed by difficult and/or costly machining or grinding. In many cases, due to the physical size or material of construction, it would be completely impractical to improve the surface finish enough to utilize the method described in the '822 patent. Finally, the metal elements of the invention in the '822 patent are limited to applications below the temperature where creep deformation begins. In fact, even utilizing the metal elements at operation temperatures that are high enough to stress-relieve the metal elements will render them substantially less effective in providing sealing. Thus, temperatures above 400° C. are completely out of the question, and temperatures above 200° C. may cause partial loss of function over long exposures.

An alternative method to that described in the '822 patent is described in U.S. Pat. No. 4,733,722, to Forbes et at. (hereinafter "the '722 patent"). The '722 patent describes elastic elements fabricated from polymer material with a specially designed shape. These sealing elements overcome the problem regarding the sensitivity to surface finish in the elements of the '822 patent. However, the elastic elements described in the '722 patent have even more severe temperature limits than the elastic elements described in the '822 patent.

The problems of limiting bypass flow using seals are made worse in heat exchangers with exceptionally high local pressure gradients in the flow passages outside the tubes. Examples of exchangers of this type are multi-pass, U-tube heat exchangers designated as shell type F in the Tubular Exchanger Manufacturers Association (TEMA) standard nomenclature. The design standards recognize the need for seals in such exchangers, and improved inter-pass seals are described in U.S. Pat. No. 4,778,005, to Smith (hereinafter "the '005 patent"). The improved seals described in the '005 patent are elastic metal elements, which are actively loaded by the gas differential pressure. Such seals still suffer the drawbacks of the circular seals described in the '822 patent to some extent, but benefit by their active nature.

TEMA standard nomenclature does not even recognize exchangers having different shell side passes within a shell which is not longitudinally divided. This indicates the inability of prior art methods to prevent deleterious leakage in such designs. U.S. Pat. No. 6,497,856 to Lomax et al. (hereinafter "the '856 patent") describes a heat exchange chemical reactor employing an array of tubes and multi-pass flow outside those tubes. In a heat exchange reactor structure of the type revealed by the '856 patent, maximum temperatures between the fluid passages outside the tubes is above 800° C., and thus too hot to employ the method described in the '822 patent. The burner required in the apparatus described in the '856 patent can create a significant pressure drop across the partition between the flow channels. This pressure drop significantly increases deleterious flow bypassing using conventional construction techniques. Further, the apparatus described in the '856 patent is specifically meant to be enhanced in performance by the provision of extended heat transfer surfaces, thus further increasing pressure drop and leakage within the heat exchange reactor.

It is therefore desirable to provide a heat exchange structure that reduces shell-side fluid leakage and bypass for tubular heat exchangers, such as those operated at high temperatures and pressures.

SUMMARY OF THE INVENTION

The present invention advantageously provides a heat exchange apparatus including a housing, a first fluid passageway provided within the housing, and an array of fluid conduits provided within the housing, where the array of fluid conduits extends through the first fluid passageway. The first fluid passageway is defined by an internal surface of the housing and by a baffle plate. The baffle plate has an extended portion that extends beyond the first fluid passageway. The housing includes a first housing member having a first wall and a flange extending from the first wall, and a second housing member having a second wall and a flange extending from the second wall. The flange of the first housing member and the flange of the second housing member are joined at a flange joint to the extended portion of the baffle plate at opposite sides of the extended portion.

The present invention further advantageously provides a housing for a heat exchange apparatus including a fluid passageway partially defined by a baffle plate, where the baffle plate has an extended portion. The heat exchange apparatus further includes an array of fluid conduits extending through the fluid passageway. The housing includes a plurality of housing members each having a wall and at least one flange extending from the wall, wherein flanges of adjacent housing members are joined at a flange joint. The flange joint is configured to fixedly receive the extended portion of the baffle plate.

The present invention also advantageously provides a heat exchange apparatus including a housing, a first fluid passageway provided within the housing, a second fluid passageway provided within the housing, and a baffle plate substantially separating the first fluid passageway from the second fluid passageway. The apparatus also includes an array of fluid conduits provided within the housing, where the array of fluid conduits extends through the first fluid passageway, the baffle plate, and the second passageway. A plate member is provided within the first fluid passageway. The array of fluid conduits extends through the plate member, and the plate member is mounted to outer surfaces of the array of fluid conduits at a predetermined distance from the baffle plate. At least one layer of intumescent material is provided between the baffle plate and the plate member, and the array of fluid conduits extends through the at least one layer of intumescent material. The at least one layer of intumescent material substantially entirely fills a gap between the baffle plate and the plate member.

The present invention advantageously provides a heat exchange apparatus including a housing, a first fluid passageway provided within the housing, a second fluid passageway provided within the housing, and an array of fluid conduits provided within the housing, where the array of fluid conduits extending through the first fluid passageway and the second passageway. A sealing zone substantially separates the first fluid passageway from the second fluid passageway. The sealing zone includes a first baffle plate that defines a portion of the first fluid passageway, and a second baffle plate that defines a portion of the second fluid passageway. The array of fluid conduits extends through the first and second baffle plates. A refractory gasket is provided between the first baffle plate and the second baffle plate, and the array of fluid conduits extends through the refractory gasket. A layer of intumescent material is provided between the first baffle plate and the second baffle plate, and the array of fluid conduits extends through the layer of intumescent material.

The present invention further advantageously provides a method of constructing a heat exchange apparatus including a fluid passageway partially defined by a baffle plate, where the baffle plate has an extended portion. The heat exchange apparatus further includes an array of fluid conduits extending through the fluid passageway. The method of constructing includes the steps of providing a plurality of housing members each having a wall and at least one flange extending from the wall, and joining flanges of adjacent housing members at a flange joint, wherein the flange joint fixedly receives the extended portion of the baffle plate, and wherein a final housing member is not joined in this step. The method also includes inserting the array of fluid conduits in fluid passageway, providing a plurality of heat transfer fins on outer surfaces of the fluid conduits of the array of conduits, and joining flanges of the final housing member to adjacent housing members to form a closed housing.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE INVENTION

Figure 1:
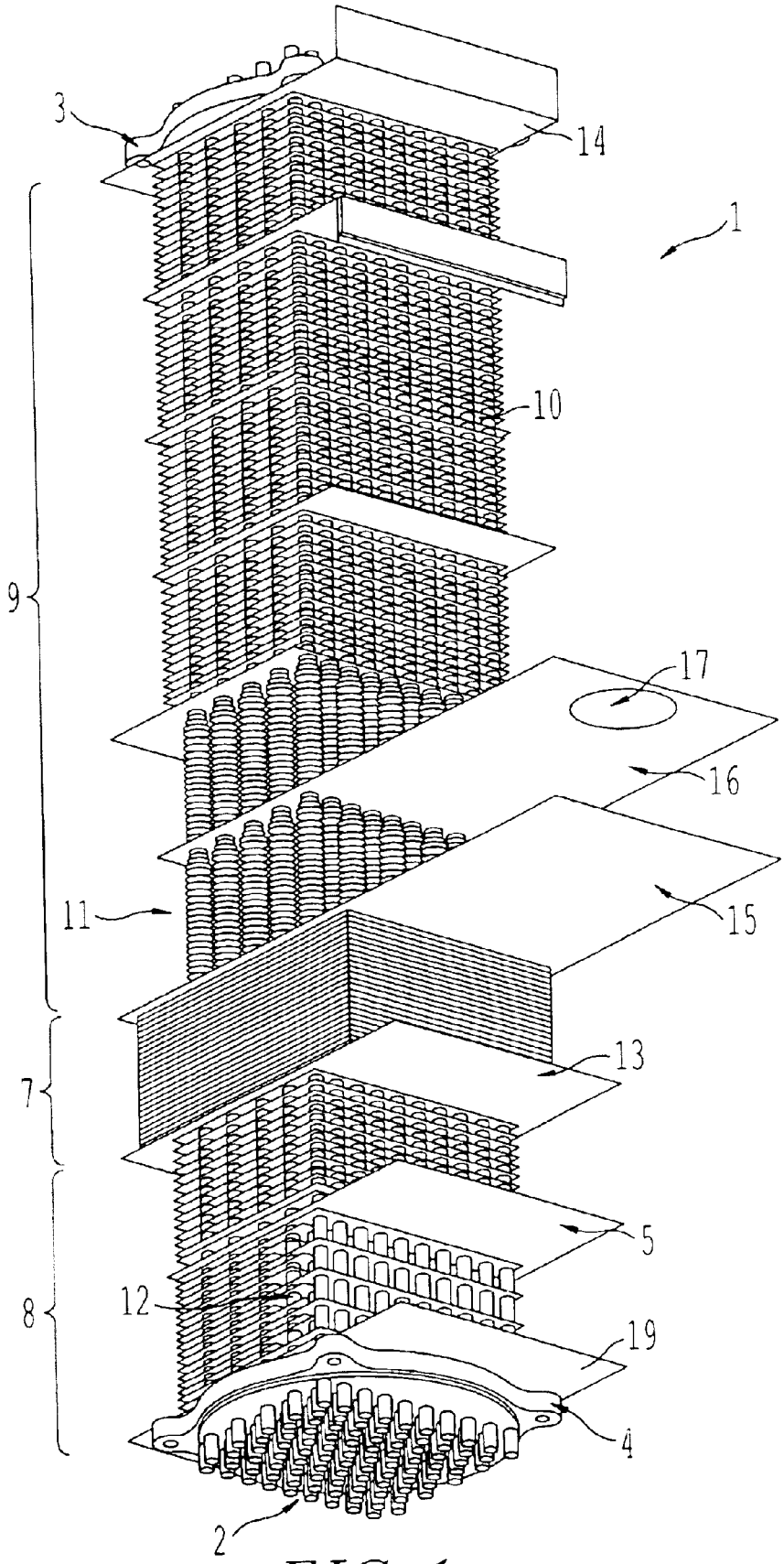
FIG. 1 depicts an isometric view of a tubular heat exchange core of the present invention.

Embodiments of the present invention will be described hereinafter with reference to the accompanying drawings. In the following description, the constituent elements having substantially the same function and arrangement are denoted by the same reference numerals, and repetitive descriptions will be made only when necessary.

FIG. 1 shows a tubular heat exchanger core including an array of substantially-parallel conduits or tubes 2, which are sealingly connected between a first tubesheet 3 and a second tubesheet 4. A first fluid flows from an inlet manifold sealingly attached to the first tubesheet 3, through tubes of the array of tubes 2, and out a second manifold attached to the second tubesheet 4. The manifolds are not shown here for the sake of clarity. The array of tubes 2 is provided on outer surfaces of the tubes with flow directing baffles or plates 5, which are used to cause a second fluid to flow substantially normal to the axis of the array of tubes 2. One or more baffles 5 may be provided to produce several consecutive stages of cross-flow of the second fluid across the array of tubes, which conveys the first fluid.

Depending upon the shape and desired construction of the heat exchanger, the baffles can be of generally circular planform, with chorded sections removed on alternating sides to engender the desired flow. The baffles in FIG. 1 are of a preferred rectangular planform. The tubular array 2 of FIG. 1 is likewise rectangular, although the present invention is in no way limited to tubular arrays and baffles having a rectangular planform, and can be provided with any planform desired.

FIG. 1 depicts a heat exchanger core configured to provide the flow arrangement of the '856 patent, which is incorporated herein in its entirety. The baffles 5 can be arranged to execute any sort of flow pattern desired, such as a simple counterflow or parallel flow heat exchange. In the flow arrangement depicted in the '856 patent, the flow of the second fluid is divided into two separate flow passageways by a sealing zone 7. In FIG. 1, a sealing method of refractory felt gaskets is employed in the sealing zone 7 between the lower flow passages 8 and the upper flow passages 9. The second fluid may flow through both of these passages after some intermediate processing, such as adding fuel to the second fluid including air and burning the resultant mixture, or a distinct third fluid may flow in one of the passages. In either case, it is likely that the fluid pressure of the streams in flow passages 7 and 8 will be different, and thus a pressure gradient will exist across the sealing zone 7.

It should also be noted that heat exchange fins may be advantageously placed on outer surfaces of the tubes in the tubular array 2 to increase heat transfer area, protect against corrosion, and provide mechanical support to the tubes. In FIG. 1 a preferred combination of plate fins 10 and circular ring fins 11 are used. There is also provided a zone 12 having tailored heat transfer fins 12. The extended heat transfer fins cause fluid friction and pressure loss, and can thus provide quite high pressure differential between cross-flow stages, and especially across the sealing zone 7.

One feature apparent in FIG. 1 is the various sizes of the baffle plates. Baffle 5 has a chorded shape preventing flow parallel to the tubes on one end of the tube array 2, while permitting flow in this direction on the opposite side. Full baffle 13, on the other hand, permits no flow parallel to the tube array 2. Extended baffle 15 provides a long plane through which no flow parallel to the tube array 2 is possible, while the similar baffle 16 provides a fluid port 17 that allows localized flow.

All of the baffles depicted in FIG. 1 have a small extended portion 18, which extends outside the flow passageways and finned zones in each fluid stage. The extended portions 18 are provided for mating to refractory ductwork for directing the flow of the second fluid.

Figure 2:
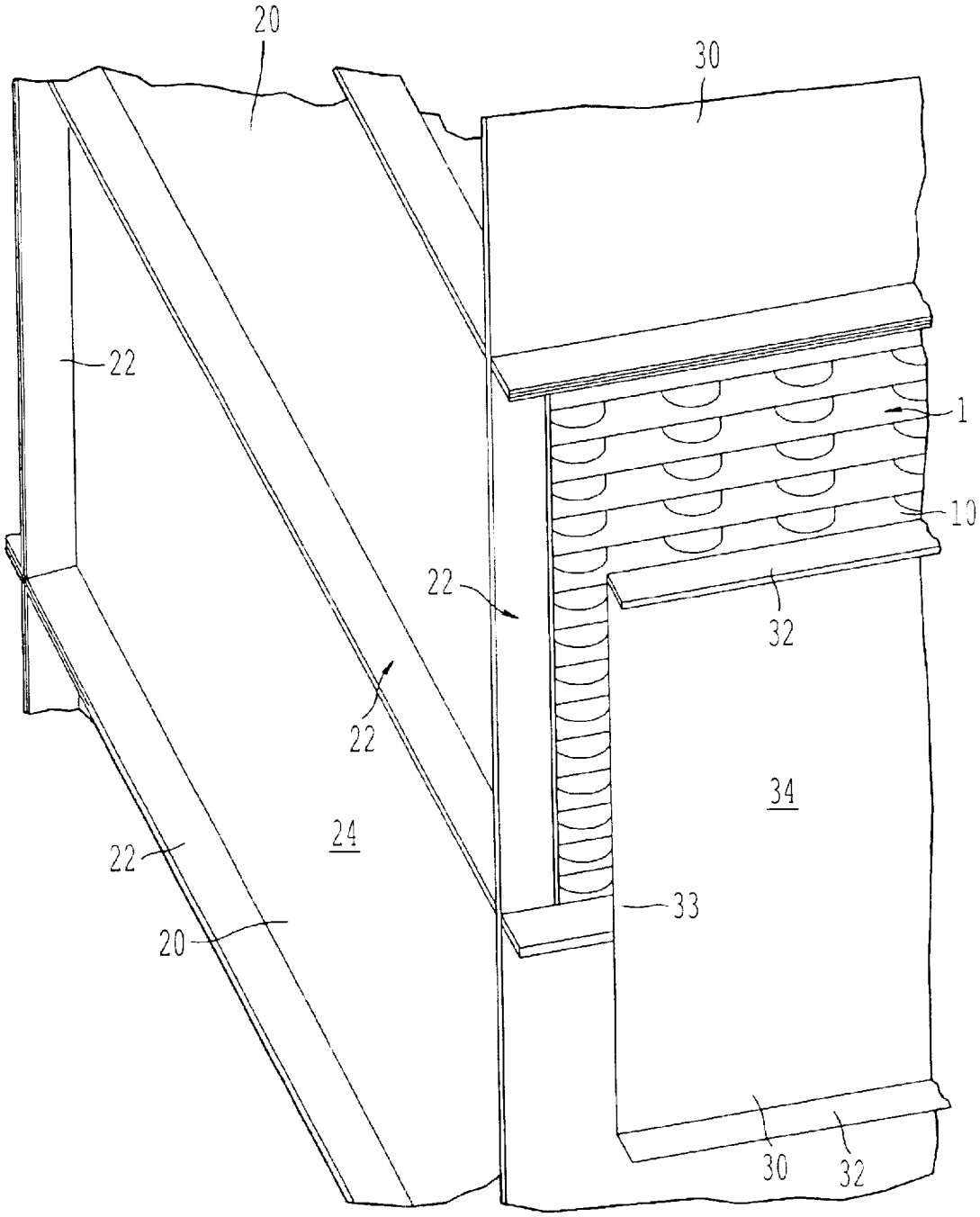
FIG. 2 depicts an isometric view of an embodiment of the fluid ducting system of the present invention.

FIG. 2 shows a structure that provides improved manifolding of the flow within a housing 100 formed by housing members, such as sheet cover pans 20, 30 and portions of various baffles that form part of the outer shell of the heat exchanger, such as portions of baffles 13–16 and 19. The housing 100 of the present invention can achieve a condition of zero leakage. In FIG. 2, the tubular heat exchanger core 1 is visible in one section where a housing member 30, such as a sheet metal cover pan, is depicted in an exploded view for clarity. On the side of the rectangular fins 10 parallel to the direction of cross-flow of the second fluid, a second housing member 20, such as a sheet metal cover pan, is visible. The second cover pans 20, which are extend in a direction parallel to the flow of the second fluid, are assembled in close contact with the extended heat transfer fins 10 of the tube array 2. The second cover pans 20 are provided with flanges 22 on all four sides, where the flanges 22 extend from a wall 24 of pan 20 at an angle of substantially ninety degrees (note that this angle will be different if a different cross-sectional configuration of housing members is used). The flanges 22 abut the baffle extended portions 18 and are joined thereto at flange joint 36 in a substantially fluid-tight manner.

The cover plates 30 are provided with two flanges 32 on opposing sides that extend from a wall 34 at an angle of substantially ninety degrees (note that this angle will be different if a different cross-sectional configuration of housing members is used). The flanges 32 abut the baffle extended portion 18, and are joined to the baffle extended portion 18 and an adjacent flange 22 of an adjacent cover pan 20 along flange joint 36. The cover plates 30 are provided with two flanges 33 on opposing sides that extend from the wall 34 in a direction substantially parallel (note that this orientation will be different if a different cross-sectional configuration of housing members is used) to the wall 34. The flanges 33 abut and are joined to an adjacent flange 22 of an adjacent cover pan 20 along flange joint 35. Thus a fluid-impermeable manifold is formed to direct the second fluid flow.

Figure 3:
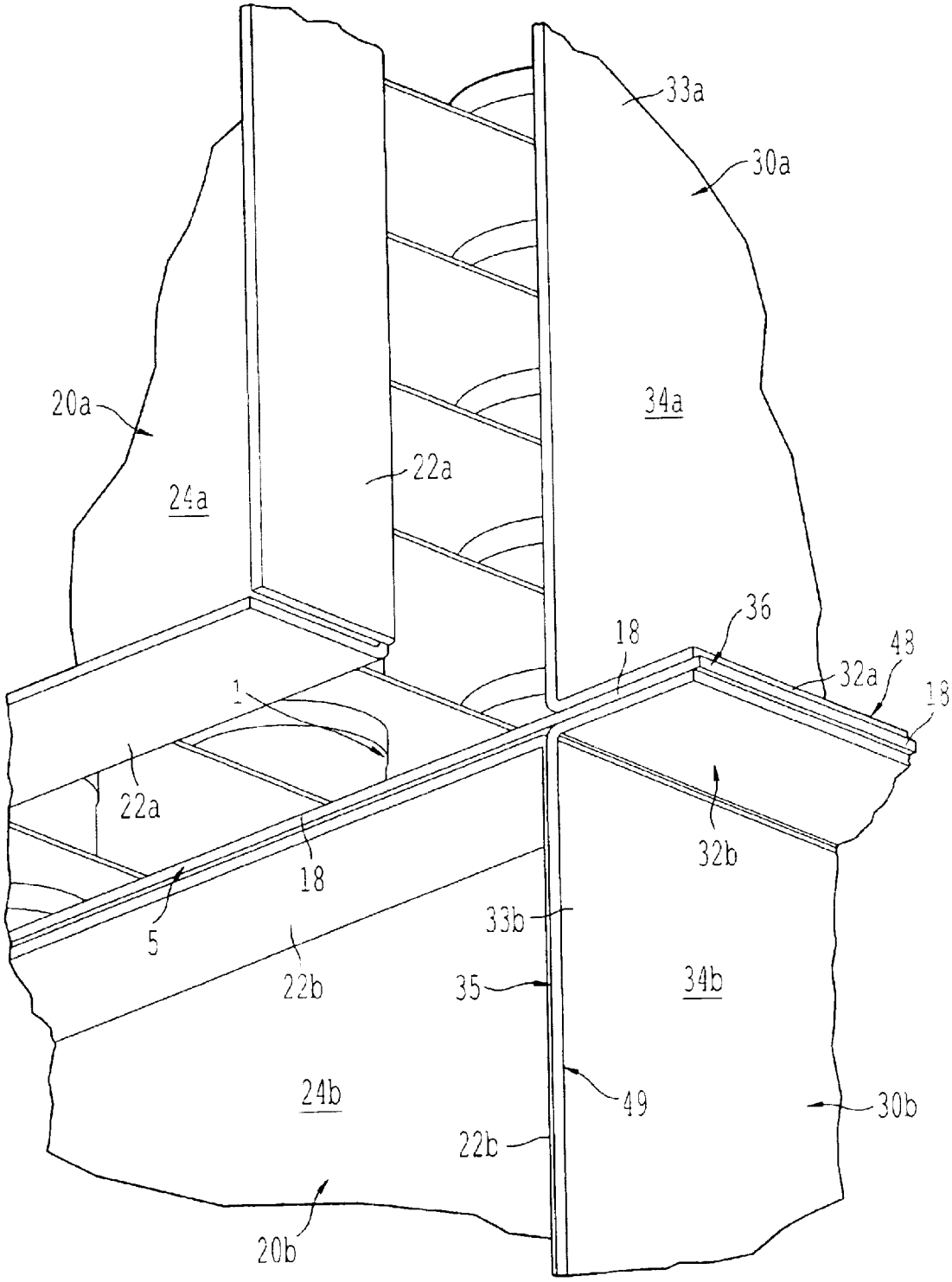
FIG. 3 depicts a detailed view of the joints in the fluid ducting system of the present invention.

The details of the pan to baffle and pan to pan joints may be more clearly understood by the exploded view in FIG. 3. The heat exchanger core 1 is again visible where a cover pan 20*a* is depicted in an exploded view. FIG. 3 also depicts another cover pan 20*b* in a lower position, which is in a normal operation position below the baffle 5. FIG. 3 depicts two cover plates 30*a* and 30*b* that are in normal operation positions, and the location of the flange joint 35 between the flange 22*b* of the side cover pan 20*b* and the flange 33*b* of the end cover pan 30*b* can be readily seen. The flange 32*a* of cover plate 30*a* and the flange 32*b* of cover plate 30*b* are more clearly shown in contact with the extended portion 18 of the baffle 5. The flange joints 35 and 36 can be made essentially fluid impermeable by methods such as welding, brazing, adhesive bonding, roll forming or other methods apparent to one skilled in the art. It is particularly advantageous to weld or roll-form the flange joint 36 at the joint of the flanges and baffle 5, such that the flanges may elastically-deflect under differential thermal expansion to relieve stresses on the assembly and prevent permanent deformation of the baffle, the pans, or both.

In an alternative embodiment of the present invention, one or more of the cover pans 20, 30 may be attached by bolts, screws, or other removable fixing devices. In such an embodiment it is preferable to provide a stationary sealing member in between the cover pans 20, 30, and between the cover pans 20, 30 and the extended portion 18 of the baffle plate 5. An advantage of this alternate embodiment is that the cover pans may be removed to inspect and/or clean the heat exchanger core 1 including the heat exchange array 2. This feature is highly-desirable under some heat exchanger service conditions, where corrosion or deposition of fouling are expected to be high.

Since, in the embodiment depicted, a flanged joint is present at both the top and bottom edge of each pan, as well as at the ends of each pan, a substantial amount of elastic deformation is possible before any permanent plastic deformation is encountered. The elastic deformation is possible since the joint is located at a distance from the wall of the pans, such as at the ends of the flanges, thereby allowing the portion of the flange between the joint and the wall to deflect under a load directed along the plane of the wall. Thus the present invention provides expansion means for allowing a distance between adjacent walls to expand under predetermined conditions, such as loads caused by thermal expansion of various parts and by thermal gradients in the heat exchanger. This is an especially advantageous aspect of the present invention, as high thermal stresses may be easily accommodated between consecutive cross-flow stages of a tubular heat exchanger employing the ducting depicted in the embodiments herein. This feature is also advantageous when extended heat transfer features are used, because these features greatly increase the amount of heat transferred per cross-flow stage, which results in higher thermal gradients across each cross-flow zone and between points in any two adjacent cross-flow zones. The ability of these highly-elastic joints to dynamically adapt to changing temperatures is also especially advantageous during transient operation and in situations when the heat exchanger is designed to operate at a variety of conditions. Thus, the apparatus is able to continue to function over a wide range of temperatures and temperature profiles without leaking. Thus, the baffles and pans do not leak when cold at starting conditions, or at off-design conditions when the temperature profiles through the heat exchanger may be significantly different than those at the design point.

The flange joints 35 and 36 form various expansion features that allow for expansion of a distance between adjacent walls to expand under predetermined conditions. Horizontal expansion features 48 can be seen at periodic intervals perpendicular to the axis of the tubular array 2. The fact that the features extend along the entire outer perimeter of the ductwork structure is also evident. The horizontal expansion features 48 allow extensive thermal expansion parallel to the tube array 2. Vertical expansion features 49 are also evident in the image. The vertical expansion features 49 allow elastic expansion perpendicular to the tube array 2. This embodiment of the present invention advantageously accommodates elastic deflections both parallel and perpendicular to the tube array 2.

The cover pans 20, 30 of the present invention may be made of any material compatible with the operating conditions. It is, however, preferred to construct the baffle pans from metal sheet stock. The flange features are then very easily formed using typical sheet metal processing, and the fluid joints can be readily made. If a tube and/or baffle array planform other than square or rectangular is used, appropriately-shaped pans and baffles may be formed, for instance in a hexagonal or octahedral shape. Even the traditional round planform can be constructed using deep drawn rounded pans formed as quarter panels (or half panels, etc.) and using traditional round baffles. The rounded pans can still be provided with the flange features (such as flanges that extend from the rounded wall at an angle of substantially ninety degrees from the portion of the wall directly adjacent to the flange) and joined using the same general method as described for the polygonal baffles and pans, thus yielding all the attendant advantages of the present invention while having far lower weight, manufacturing cost and materials cost than traditional shell constructions.

Figure 4:
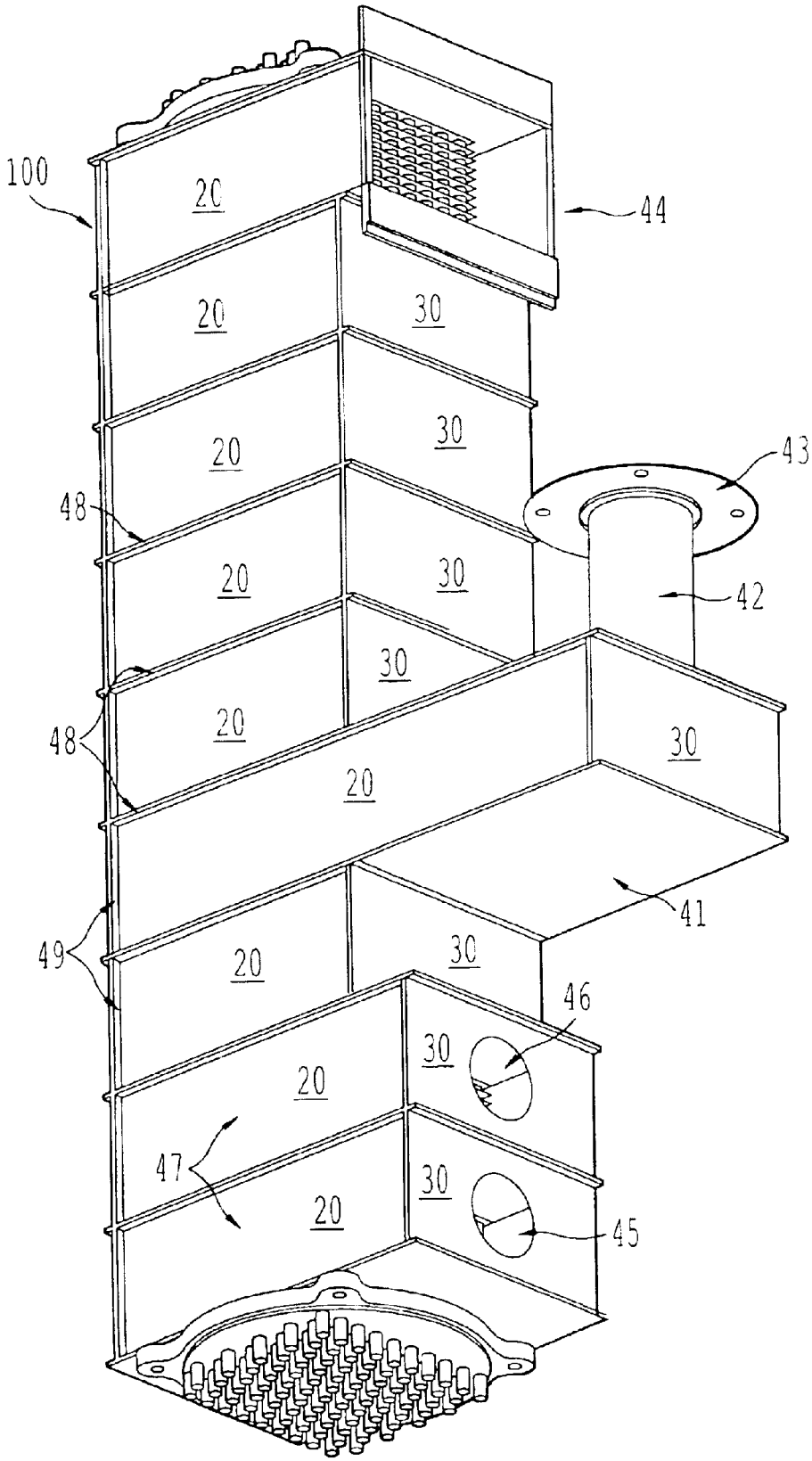
FIG. 4 depicts an isometric view of the tubular heat exchanger core of FIG. 1 with the ducting system of the present invention in place.

FIG. 4 shows the tubular heat exchange core of FIG. 1 outfitted with the housing 100 including the baffle and pan ductwork system of the present invention. The flexibility of the present invention is evident in the provision of a burner box 41 formed from elongated cover panels and the elongated baffles 15 and 16. The burner flame tube 42 is mounted substantially-parallel to the tubular array 2, and is provided with an attachment flange 43. Conventional monolithic shells cannot accommodate extended chambers without difficult and tedious fitting of large welds in thick plates, and typically utilize reduced area pipes which are smaller than the chamber, thus resulting in a high potential for flow maldistribution. Worse, in high temperature applications such as ducting hot flue gas from a burner, radiant heat transfer may be important, and such small connections can cause uneven heat transfer, thus imposing significant thermal stresses.

In addition to inlets and/or outlets substantially-parallel to the tube array 2 such as burner box 41, second fluid inlets that are perpendicular to the tube array 2 can be easily provided. These can include various fluid connection ports including full-area flanged connections, such as connection 44, as well as reduced area tube or pipe connections 45 and 46. The flow distribution from the reduced area connections can be significantly improved when appended manifold chambers 47 are provided by using extended cover pans. Like the burner box 41, the manifold chambers 47 allow extremely uniform flow distribution when compared to simple pipe connection, since the extended portion provides a manifolding area that is not restricted by the heat transfer fins 10.

All of the figures have illustrated cover panels covering an entire side of a polygonal tube array with one panel. In some applications, the service pressure and temperature combined with the dimension of the heat exchange core 1 make it desirable to provide a number of sub-panels on one or more sides. This advantageously reduces the mechanical stresses for a given cover plate thickness and provides additional thermal expansion joints. Thus, the number and thickness of cover plates provided in a given location may be varied to suit the local temperature and stress conditions.

Figure 5:
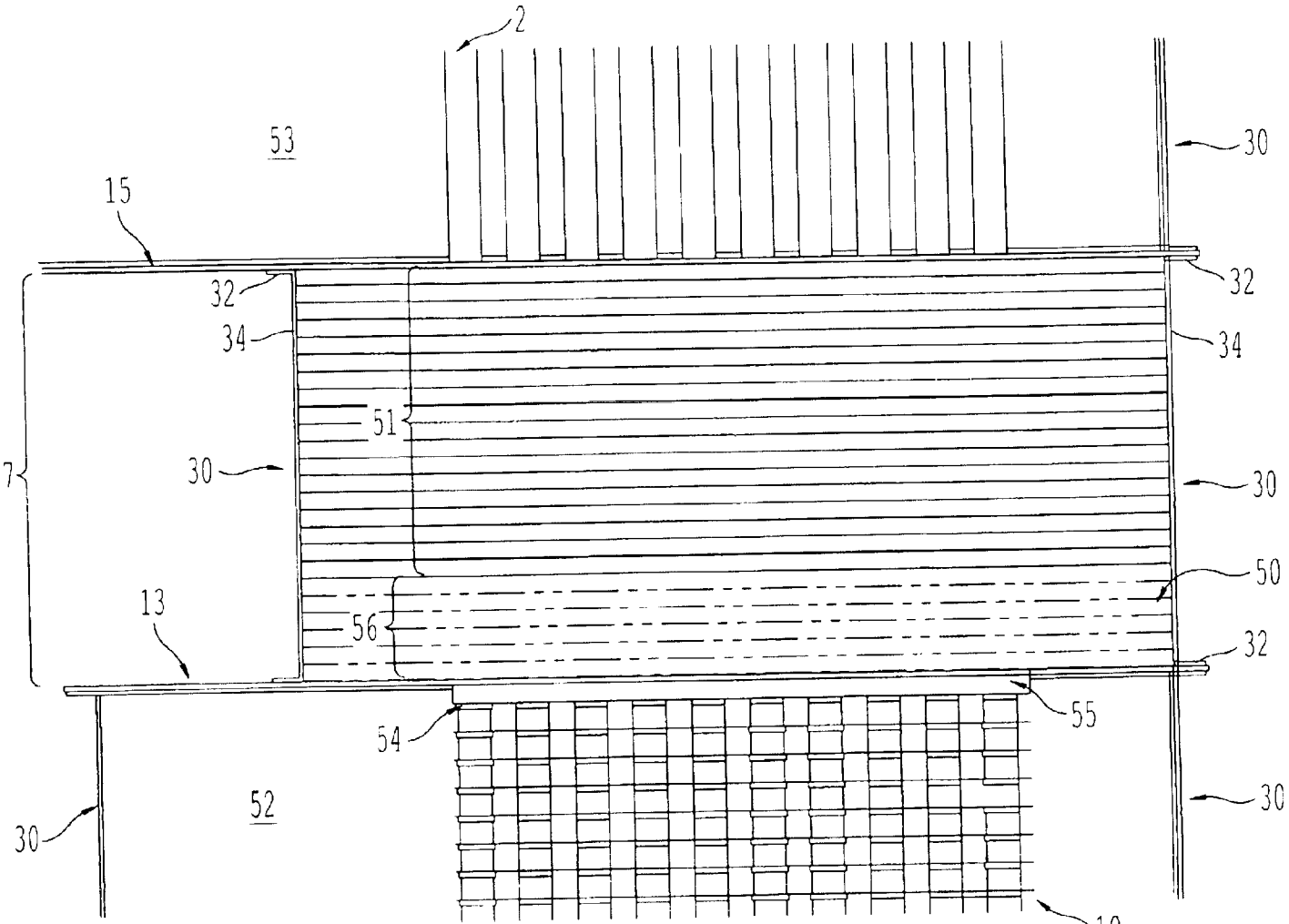
FIG. 5 depicts a side section view of a captured intumescent seal of the present invention.

FIG. 5 is a side section view of the heat exchanger sealing zone 7 of the present invention. The sealing zone 7 is defined by baffle plates 13 and 15. FIG. 5 shows the array of substantially parallel tubes 2 with the associated plate fins 10. The front and rear cover plates 30 are also visible and are joined to the extended baffle plate 15 and the full baffle plate 13. The ring fins 11 are omitted from FIG. 5 for clarity of presentation.

The baffle plates have local gaps between surfaces of the holes therethrough and the tubes of the tube array 2 that pass through the holes. These gaps may have any dimension dictated by the method of fabrication chosen and the particulars of the design of the heat exchange structure. Additional gaps 50 may exist between refractory felt seals 51 and the cover pan wall within the sealing zone 7. The gaps 50 can be minimized using the present invention due to the method of construction of the housing. The gaps provide fluid leak paths which lead to fluid transport between the first cross-flow fluid passageway 52 and the second cross-flow fluid passageway 53. As noted previously, these two passageways may convey the same fluid or two different fluids, but in either case it is likely that a pressure differential will exist between the fluid passages. In certain configurations the upper fluid passageway 53 contains a high temperature burner flue gas at a first pressure, while the lower fluid passage 52 contains preheated burner air at a second, higher pressure. In this case, the refractory felt seals 51 would function to reduce leakage and thermal stresses. However, the drawbacks of the refractory felt materials have already been documented.

An embodiment of the present invention preferably includes the sealing zone 7 depicted in FIG. 5, which is especially useful when the fluid in passageway 53 is at a temperature above a service limit for intumescent material of 800° C. and the fluid in passageway 52 is below the service limit for the intumescent material. In this embodiment, the gap between the baffle plates 13 and 15 is filled with one or more layers of refractory material, such as refractory felt gaskets 51, cast with moldable refractory fiber, or stuffed with loose refractory fibers. The refractory material is in intimate contact with the baffle 15, which is in contact with the fluid passageway 53. This refractory material is initially installed in sealing contact with the tubes of the tube array 2, the baffle 15, and the internal surface of the housing 100. One or more layers of intumescent material 56, which are depicted by dashed lines in FIG. 5, are then provided between the refractory material 51 and the baffle 13. The intumescent material 56 is separated from the fluid passage 53 by sufficient refractory 51, which acts as a thermal insulator to prevent overheating of the intumescent material 56. The two baffles are held in essentially fixed mechanical relationship by mechanical means such as connection to baffle support rods as known in the art, by mechanical capture between layers of extended heat exchange fins in intimate contact with the tubes 1, or by other means apparent to one skilled in the art.

Upon heating above 300° C., the intumescent material 56 expands normal to the face of the baffles 13, 15. This expansion subjects the refractory 51 to substantial pressure. Under this pressure, the refractory 51 is compressed to a higher density than when it was installed. Further, the refractory 51 is forced by this pressure into improved sealing contact with the tubes of the tube array 2 and internal surface of the housing 100. Because the cover plates of the housing 100 are essentially fixed, the expansion of the intumescent material 56 in a direction parallel to the tubes is thus converted into a uniform pressure to the refractory felt material 51.

The choice of thickness of the refractory material 51 and the quantity of intumescent material 56 is dictated by the desired compression of the refractory 51 in question, the refractory's anticipated shrinkage in service, the expansion characteristics of the intumescent material 56, and the mechanical strength of the baffles, pans (housing) and their mechanical supports. Thus, many different combinations are possible which may be uniquely suited to the exact type of heat exchanger anticipated and its operating conditions.

In a preferred embodiment of the present invention, a plate member 54 is provided parallel to the baffle plate 13. The plate member 54 is spaced a distance from the baffle plate 13. The plate 54 can be an identical baffle plate, or can be an extended heat transfer plate fin as shown in FIG. 5, or an array of individual fins. The gap distance between the baffle plate 13 and the plate 54 is maintained essentially fixed by mechanical means such as connection to baffle support rods, by mechanical capture between layers of extended heat exchange fins in intimate contact with the tubes of the tube array 2, or by other means apparent to one skilled in the art.

The gap between the substantially-parallel plates 13, 54 is filled with a material 55, which expands at elevated temperatures. A preferred example is an intumescent mat comprising vermiculite alone or in combination with a system of refractory fibers and binders. An especially preferred material is intumescent mat as employed to restrain catalytic converter elements in automotive applications. This intumescent mat material is unique in its ability to expand at temperatures between 300° C. and 375C., and to remain elastic at temperatures as high as 800° C. for extended exposure. The use of this material is well-known in the art to retain catalytic converter monoliths and for fire stopping. Intumescent mat has the unique property of expanding much more noticeably normal to its thickness than parallel to its thickness. Therefore, its use as a sealing member alone is ineffective in a tubular array heat exchanger of the type contemplated here. Constraining the intumescent mat 55 between the baffle plate 13 and the fin 54, which themselves are held in essentially fixed relation to one another, causes the intumescent mat, which would otherwise expand only normal to the plane of the baffle plate 13 to be forced into intimate sealing contact with the tubes of the tube array 2 and the fluid passage perimeters. This constrained expansion is thus able to apply a substantially leak-tight contact to prevent flow between the fluid passages 52 and 53 through the gaps.

The intumescent material used for the intumescent seal 55 and the intumescent material 56, once expanded by heating to temperature between 300° C. and 375° C., retains its expanded state and is substantially elastic over very high numbers of cycles at high temperature. Thus, the sealing pressure is retained from cold starting condition through hot operating condition with essentially constant fluid leakage prevention.

The especially preferred intumescent mat products are formulated to resist erosion by flowing heated gas. Thus, a captured intumescent seal of the present invention is inherently resistant to failure by erosion.

It can be readily appreciated based upon the above description that improved sealing can be obtained by combining a captured intumescent seal 55, such as that described above, with a sealing zone 7 employing a composite of an intumescent material 56 and a refractory 51. Such a combination is shown in FIG. 5 and offers increased reduction in leakage compared to either method used singly.

It may also be readily appreciated that although the sealing techniques of the present invention are exceptionally well-suited to use in combination with the housing and baffles of the present invention, they may also be used with excellent effect in the standard tube and shell heat exchangers to facilitate operation at temperatures unattainable with other sealing methods. The methods of the present invention can also extend the operability of tube and shell heat exchange methods to exchangers having multiple shell-side fluid passes, significantly extending the applicability of such heat exchangers relative to previous practice. The combination of the ducting and sealing methods further ensures multi-pass, high-temperature tubular heat exchangers with high performance using extended heat transfer fins of high density, and thus high pressure drop.

An important additional advantage of the pan and baffle ductwork system of the present invention is in assembly or construction of the tubular heat exchanger. Some other shell and tube heat exchangers are constructed in two stages. The heat exchange core structure is fabricated separately from the shell assembly, and then is inserted into the shell. This traditional assembly procedure requires either extremely tight tolerances in the assembly of the heat exchanger tubular core and shell, or relatively wide tolerances and large gaps, which engender the fluid leakage eliminated in the present invention. Additionally, in these other configurations the heat exchanger core must be handled very carefully to avoid damage when disassembled. It is almost impossible to avoid damage to the core, the shell, or both when the exchanger is operated in corrosive or fouling condition as well, as the corrosion and/or fouling residues tend to bind the tubular core in the shell. Furthermore, these other configurations of heat exchangers must be installed with sufficient room in the direction of core removal to permit free access of equipment and adequate room for the core to be extracted.

In a preferred embodiment of the present invention, the heat exchanger is assembled one cross-flow pass at a time, using the cover pans and baffles as fixtures to guide the assembly process. This allows manual assembly to proceed especially-rapidly, as tedious counting of heat transfer fins can be minimized, and fins are added until they match the height of the cover pans. This method also advantageously reduces the tolerance requirements for each parts, as each component of the shell is far smaller, which makes holding tighter tolerances far easier than when handling a large shell. This is further aided by the thin gage thicknesses needed for the cover pans, as the thin materials may be easily formed to a precise shape, and any mismatch may be readily corrected during assembly.

The present invention also makes handling the core easy, because a partially-assembled housing with baffles can be used as a structural cradle to support the weight of the heat exchanger components during assembly. For example, the present invention provides a method of constructing the heat exchange apparatus where the housing 100 including the housing members 20, 30 and baffles plates 5, 13–16, and 19 are assembled, except for housing members extending along one side of the housing 100 (e.g., leaving one or more of housing members 20 visible in FIG. 4 off in order to leave opening(s) along the side of the housing 100), thereby forming a cradle with openings along the side of the housing 100 to allow a worker to assemble the core 1. The worker can then insert the array of fluid conduits 2 in the fluid passageways and provide a plurality of heat transfer fins 10 on outer surfaces of the fluid conduits of the array of conduits 2 through the open side of the housing 100. Once the core I is fully assembled, then the remaining housing members are joined to adjacent housing members to form a closed housing 100.

The heat exchanger constructed in the above manner can be inspected by disassembling portions of the housing 100, for example removing one or more housing members 20, 30, without moving the heat exchanger. This may be done by selectively providing removable housing members 20, 30 as described previously, or by severing the exposed flange joints. The former incurs more manufacturing expense and a greater chance of eventual leakage of the shell, while the latter ensures a hermetically-sealed second fluid ductwork, but requires more labor in the field. Thus, neither method is preferable in general. In either case, since the core does not need to be removed from the housing, then no crane is required even for large heat exchangers. Further, the heat exchanger may be sited without accounting for space to permit removing the core for inspection or cleaning. Thus, any chance of damaging the core during removal of the core from the housing is also eliminated. Thus, the present invention is well-suited to heat exchangers intended for corrosive or fouling service. It also enables the use of less mechanically-robust components as the potential forces encountered in traditional core removal need not be considered.

It should be noted that the exemplary embodiments depicted and described herein set forth the preferred embodiments of the present invention, and are not meant to limit the scope of the claims hereto in any way.

Numerous modifications and variations of the present invention are possible in light of the above teachings. It is therefore to be understood that, within the scope of the appended the invention may be practiced otherwise than as specifically described herein.

What is claimed as new and desired to be secured by Letters Patent of the United States is:

1. A heat exchange apparatus comprising:

a housing;

a first fluid passageway provided within said housing, said first fluid passageway being defined by an internal surface of said housing and by a baffle plate, said baffle plate having an extended portion that extends beyond said first fluid passageway; and an array of fluid conduits provided within said housing and extending between an inlet manifold tubesheet and an outlet manifold tubesheet, said array of fluid conduits extending through said first fluid passageway, wherein said baffle plate is provided at a location between said inlet manifold tubesheet and said outlet manifold tubesheet, wherein said housing includes a first housing member having a first wall and a flange extending from said first wall, said housing further including a second housing member having a second wall and a flange extending from said second wall, and wherein said flange of said first housing member and said flange of said second housing member are both joined at a single flange joint to said extended portion of said baffle plate at opposite sides of said extended portion.

2. The heat exchange apparatus according to claim 1, wherein said array of fluid conduits extend through said baffle plate.

3. The heat exchange apparatus according to claim 1, wherein said first wall and said second wall define a portion of said internal surface of said first fluid passageway.

4. The heat exchange apparatus according to claim 1, wherein said housing comprises a plurality of housing members each having a wall and at least one flange extending from said wall, wherein flanges of adjacent housing members are joined.

5. The heat exchange apparatus according to claim 1, wherein said flange of said first housing member is detachably joined to said extended portion of said baffle plate.

6. The heat exchange apparatus according to claim 5, wherein a seal member is provided in between said flange of said first housing member and said extended portion of said baffle plate.

7. The heat exchange apparatus according to claim 1, wherein said array of fluid conduits having a plurality of heat transfer fins provided on outer surfaces of said fluid conduits, said plurality of heat transfer fins extending within said first fluid passageway.

8. The heat exchange apparatus according to claim 1, wherein said baffle plate has a portion with a fluid port.

9. The heat exchange apparatus according to claim 1, wherein said wall of said first housing member has a fluid connection port.

10. The heat exchange apparatus according to claim 1, wherein said array of fluid conduits extend through said baffle plate, wherein said extended portion of said baffle plate extends around an entire perimeter of said baffle plate, and wherein said heat exchange apparatus further comprises a second fluid passageway provided within said housing, said second fluid passageway being defined by an additional internal surface of said housing, said array of fluid conduits extending through said second fluid passageway.

11. A heat exchange apparatus comprising:

a housing;

a first fluid passageway provided within said housing, said first fluid passageway being defined by an internal surface of said housing and by a baffle plate, said baffle plate having an extended portion that extends beyond said first fluid passageway; and an array of fluid conduits provided within said housing, said array of fluid conduits extending through said first fluid passageway, wherein said housing includes a first housing member having a first wall and a flange extending from said first wall, said housing further including a second housing member having a second wall and a flange extending from said second wall, and wherein said flange of said first housing member and said flange of said second housing member are joined at a flange joint to said extended portion of said baffle plate at opposite sides of said extended portion, wherein said heat exchange apparatus further comprises:

a plate member provided within said first fluid passageway, said array of fluid conduits extending through said plate member, said plate member being mounted to outer surfaces of said array of fluid conduits at a predetermined distance from said baffle plate; and at least one layer of intumescent material provided between said baffle plate and said plate member, said array of fluid conduits extending through said at least one layer of intumescent material, wherein said at least one layer of intumescent material substantially entirely fills a gap between said baffle plate and said plate member.

12. The heat exchange apparatus according to claim 11, wherein said at least one layer of intumescent material is made of a material that expands at a temperature above about 300° C.

13. A heat exchange apparatus comprising:

a housing;

a first fluid passageway provided within said housing, said first fluid passageway being defined by an internal surface of said housing and by a baffle plate, said baffle plate having an extended portion that extends beyond said first fluid passageway; and an array of fluid conduits provided within said housing, said array of fluid conduits extending through said first fluid passageway, wherein said housing includes a first housing member having a first wall and a flange extending from said first wall, said housing further including a second housing member having a second wall and a flange extending from said second wall, and wherein said flange of said first housing member and said flange of said second housing member are joined at a flange joint to said extended portion of said baffle plate at opposite sides of said extended portion, wherein said second fluid passageway is further defined by an additional baffle plate having an extended portion that extends beyond said second fluid passageway, said array of fluid conduits extending through said additional baffle plate, said extended portion of said additional baffle plate extending around an entire perimeter of said additional baffle plate, wherein said housing includes a third housing member having a third wall and a flange extending from said third wall, wherein said flange of said second housing member and said flange of said third housing member are joined to said extended portion of said additional baffle plate at opposite sides of said extended portion, and wherein said heat exchange apparatus further comprises:

a refractory gasket provided between said baffle plate and said additional baffle plate, said array of fluid conduits extending through said refractory gasket; and a layer of intumescent material provided between said baffle plate and said additional baffle plate, said array of fluid conduits extending through said layer of intumescent material.

14. The heat exchange apparatus according to claim 13, wherein said refractory gasket and said layer of intumescent material substantially entirely fill a gap between said baffle plate and said additional baffle plate.

15. The heat exchange apparatus according to claim 13, wherein said layer of intumescent material is made of a material that expands at a temperature above about 300° C.

16. The heat exchange apparatus according to claim 1, wherein said flange joint comprises expansion means for allowing a distance between said first wall and said second wall to expand under predetermined conditions.

17. The heat exchange apparatus according to claim 16, wherein said expansion means allows for expansion of the distance in a direction parallel to an axial direction of a fluid conduit of said array of fluid conduits.

18. The heat exchange apparatus according to claim 16, wherein said expansion means allows for expansion of the distance in a direction perpendicular to an axial direction of a fluid conduit of said array of fluid conduits.

19. A housing for a heat exchange apparatus including a fluid passageway partially defined by a baffle plate, the baffle plate having an extended portion, the heat exchange apparatus further including an array of fluid conduits extending through the fluid passageway and extending between an inlet manifold tubesheet and an outlet manifold tubesheet, said housing comprising:

a plurality of housing members each having a wall and at least one flange extending from said wall, wherein flanges of adjacent housing members are joined at a flange joint, wherein said flange joint is configured to fixedly receive the extended portion of the baffle plate, and wherein said baffle plate is provided at a location between said inlet manifold tubesheet and said outlet manifold tubesheet.

20. The housing according to claim 19, wherein said housing comprises a first section having a four-sided cross-section including two opposing first housing members and two opposing second housing members, wherein each first housing member has a wall and at least two flanges on opposite sides of said wall, said at least two flanges extending from said wall of said first housing members at an angle of substantially ninety degrees from said wall, wherein each second housing member has a wall and at least two flanges on opposite sides of said wall, said at least two flanges extending from said wall of said second housing members along a plane substantially parallel to said wall, and wherein each flange of said at least two flanges of each first housing member is joined to a flange of said at least two flanges of an adjacent second housing member.

21. The housing according to claim 20, wherein said housing comprises a second section having a four-sided cross-section including two opposing first housing members and two opposing second housing members, and wherein said second section is stacked upon said first section and joined to said first section.

22. The housing according to claim 21, wherein said first section has a cross-sectional area that differs from a cross-sectional area of said second section.

23. The housing according to claim 21, wherein each of said first housing members and said second housing members of said first section have an expansion flange extending from said wall thereof at an angle of substantially ninety degrees from said wall thereof, wherein each of said first housing members and said second housing members of said second section have an expansion flange extending from said wall thereof at an angle of substantially ninety degrees from said wall thereof, and wherein said expansion flanges of said first section are joined to respective expansion flanges of said second section to form four expansion joints between said first section and said second section.

24. The housing according to claim 23, wherein three of said four expansion joints are configured to fixedly receive extended portions of the baffle plate.

25. The housing according to claim 23, wherein said expansion flanges of said first section are detachably joined to said respective expansion flanges of said second section.

26. The housing according to claim 25, wherein a seal member is provided in between said expansion flanges of said first section and said respective expansion flanges of said second section.

27. The housing according to claim 19, wherein said flange joint comprises expansion means for allowing a distance between said walls of said adjacent housing members to expand under predetermined conditions.

28. The housing according to claim 27, wherein said expansion means allows for expansion of the distance in a direction parallel to an axial direction of a fluid conduit of said array of fluid conduits.

29. The housing according to claim 27, wherein said expansion means allows for expansion of the distance in a direction perpendicular to an axial direction of a fluid conduit of said array of fluid conduits.

30. The housing according to claim 19, wherein said wall of at least one of said plurality of housing members has a fluid connection port.

31. A heat exchange apparatus comprising:

a housing;

a first fluid passageway provided within said housing;

a second fluid passageway provided within said housing;

a baffle plate substantially separating said first fluid passageway from said second fluid passageway;

an array of fluid conduits provided within said housing, said array of fluid conduits extending through said first fluid passageway, said baffle plate, and said second passageway;

a plate member provided within said first fluid passageway, said array of fluid conduits extending through said plate member, said plate member being mounted to outer surfaces of said array of fluid conduits at a predetermined distance from said baffle plate; and at least one layer of intumescent material provided between said baffle plate and said plate member, said array of fluid conduits extending through said at least one layer of intumescent material, wherein said at least one layer of intumescent material substantially entirely fills a gap between said baffle plate and said plate member.

32. The heat exchange apparatus according to claim 31, wherein said at least one layer of intumescent material is made of a material that expands at a temperature above about 300° C.

33. The heat exchange apparatus according to claim 31, wherein said at least one layer of intumescent material is made of vermiculite.

34. The heat exchange apparatus according to claim 33, wherein said at least one layer of intumescent material is further made of refractory fibers and a binder.

35. A heat exchange apparatus comprising:

a housing;

a first fluid passageway provided within said housing;

a second fluid passageway provided within said housing;

an array of fluid conduits provided within said housing, said array of fluid conduits extending through said first fluid passageway and said second passageway; and a sealing zone substantially separating said first fluid passageway from said second fluid passageway, said sealing zone comprising:

a first baffle plate that defines a portion of said first fluid passageway, said array of fluid conduits extending through said first baffle plate;

a second baffle plate that defines a portion of said second fluid passageway, said array of fluid conduits extending through said second baffle plate;

a refractory gasket provided between said first baffle plate and said second baffle plate, said array of fluid conduits extending through said refractory gasket; and a layer of intumescent material provided between said first baffle plate and said second baffle plate, said array of fluid conduits extending through said layer of intumescent material.

36. The heat exchange apparatus according to claim 35, wherein said refractory gasket and said layer of intumescent material substantially entirely fill a gap between said first baffle plate and said second baffle plate.

37. The heat exchange apparatus according to claim 35, wherein said layer of intumescent material is made of a material that expands at a temperature above about 300° C.

38. The heat exchange apparatus according to claim 35, wherein said layer of intumescent material is made of vermiculite.

39. The heat exchange apparatus according to claim 38, wherein said layer of intumescent material is further made of refractory fibers and a binder.

40. The heat exchange apparatus according to claim 35, further comprising:

a plate member provided within said first fluid passageway, said array of fluid conduits extending through said plate member, said plate member being mounted to outer surfaces of said array of fluid conduits at a predetermined distance from said first baffle plate; and at least one layer of intumescent material provided between said first baffle plate and said plate member, said array of fluid conduits extending through said at least one layer of intumescent material, wherein said at least one layer of intumescent material substantially entirely fills a gap between said first baffle plate and said plate member.

41. The heat exchange apparatus according to claim 40, wherein said at least one layer of intumescent material is made of a material that expands at a temperature above about 300° C.

42. A method of constructing a heat exchange apparatus including a fluid passageway partially defined by a baffle plate, where the baffle plate has an extended portion, the heat exchange apparatus further including an array of fluid conduits extending through the fluid passageway, said method of constructing comprising the steps of:

providing a plurality of housing members each having a wall and at least one flange extending from the wall;

joining flanges of adjacent housing members at a flange joint, wherein the flange joint fixedly receives the extended portion of the baffle plate, and wherein a final housing member is not joined in this step;

inserting the array of fluid conduits in fluid passageway;

providing a plurality of heat transfer fins on outer surfaces of the fluid conduits of the array of conduits; and joining flanges of the final housing member to adjacent housing members to form a closed housing.

43. A housing for a heat exchange apparatus including a fluid passageway partially defined by a baffle plate, the baffle plate having an extended portion, the heat exchange apparatus further including an array of fluid conduits extending through the fluid passageway, said housing comprising:

a first housing member having a first wall; and a second housing member having a second wall, wherein said first housing member and said second housing member are joined by a joint that is configured to receive the extended portion of the baffle plate, wherein said joint comprises an expansion means for allowing a distance between said first wall and said second wall to expand and contract under elastic deformation, and wherein said joint is leak-tight in an elastically deformed state.

44. The housing according to claim 43, wherein said expansion means allows for expansion of the distance in a direction parallel to an axial direction of a fluid conduit of said array of fluid conduits.

45. The housing according to claim 43, wherein said expansion means allows for expansion of the distance in a direction perpendicular to an axial direction of a fluid conduit of said array of fluid conduits.

* * * * *